US010471749B2

(12) United States Patent
Xu et al.

(10) Patent No.: US 10,471,749 B2
(45) Date of Patent: Nov. 12, 2019

(54) HINGE SET

(71) Applicant: Hewlett-Packard Development Company, L.P., Houston, TX (US)

(72) Inventors: Deming Xu, Singapore (SG); Keng San Chia, Singapore (SG); Jaewan Park, Singapore (SG); Amy Wan, Singapore (SG); Chee Hiang Koh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,060

(22) PCT Filed: Oct. 30, 2015

(86) PCT No.: PCT/US2015/058245
§ 371 (c)(1),
(2) Date: Jan. 26, 2018

(87) PCT Pub. No.: WO2017/074415
PCT Pub. Date: May 4, 2017

(65) Prior Publication Data

US 2018/0229522 A1 Aug. 16, 2018

(51) Int. Cl.
*E05F 1/14* (2006.01)
*B41J 29/02* (2006.01)
(Continued)

(52) U.S. Cl.
CPC ..... *B41J 29/023* (2013.01); *B41J 29/02* (2013.01); *B41J 29/13* (2013.01); *E05D 3/12* (2013.01);
(Continued)

(58) Field of Classification Search
CPC ..... Y10T 16/53826; Y10T 16/5383; Y10T 16/5398; Y10T 16/53984; Y10T 16/53985;
(Continued)

(56) References Cited

U.S. PATENT DOCUMENTS 938,952 A * 11/1909 Berg ..... E05F 5/027 16/334
3,590,420 A * 7/1971 Salice ..... E05D 3/142 16/335
(Continued)

FOREIGN PATENT DOCUMENTS

JP 11107618 4/1999
JP 2005120756 5/2005
(Continued)

OTHER PUBLICATIONS

Brad Short, "Homer Product Design" Web page, Various dates, 24 pages. Retrieved from Internet on Jan. 24, 2018. <http://portfolio.bradshort.com/homer/product_design/product_design.htm>.
(Continued)

*Primary Examiner* — Chuck Y Mah
(74) *Attorney, Agent, or Firm* — HP Inc. Patent Department

(57) ABSTRACT

Examples of a hinge set for used for mounting a protractible component of a device are described herein. In an example, the hinge set comprises a support hinge and a guide hinge, each having a first end and a second end. The first end of the support hinge is to pivotably couple to the protractible component and the second end of the support hinge is pivotably coupled to a frame of the device. Further, the first end of the guide hinge is to guide the protractile component and the second end of the guide hinge is to pivotably couple to the frame.

12 Claims, 6 Drawing Sheets

(51) Int. Cl.

| | |
|---|---|
| ***E05D 5/00*** | (2006.01) |
| ***E05D 5/02*** | (2006.01) |
| ***E05F 5/00*** | (2017.01) |
| ***B41J 29/13*** | (2006.01) |
| ***E05D 3/12*** | (2006.01) |
| ***E05F 5/06*** | (2006.01) |
| ***E05D 9/00*** | (2006.01) |

(52) U.S. Cl.
CPC ..... *E05D 5/00* (2013.01); *E05D 5/02* (2013.01); *E05D 9/00* (2013.01); *E05F 5/00* (2013.01); *E05F 5/06* (2013.01); *E05Y 2201/214* (2013.01); *E05Y 2201/426* (2013.01); *E05Y 2800/205* (2013.01); *E05Y 2900/20* (2013.01); *E05Y 2900/606* (2013.01)

(58) Field of Classification Search
CPC ..... Y10T 16/53987; Y10T 16/526; Y10T 16/54028; Y10T 16/54029; Y10T 16/547; E05D 11/10; E05D 11/1007; E05D 11/1064; E05D 3/12; E05D 3/00; E05D 3/02; E05D 9/00; E05F 1/12; E05F 1/1246; E05F 1/1253; E05F 5/00; E05F 5/06; E05Y 2201/638; E05Y 2201/214; E05Y 2201/426; E05Y 2800/205; E05Y 2900/20; E05Y 2900/606; B41J 29/023; B41J 29/02; B41J 29/13
See application file for complete search history.

(56) References Cited

U.S. PATENT DOCUMENTS

| | | | | | |
|---|---|---|---|---|---|
| 3,927,439 | A * | 12/1975 | Gronbach | E05F 1/1261 | 16/290 |
| 3,978,549 | A * | 9/1976 | Vitt | E05D 3/183 | 16/245 |
| 4,083,082 | A * | 4/1978 | Holmes | E05D 3/142 | 16/288 |
| 4,424,606 | A * | 1/1984 | Sorimachi | E05F 1/1261 | 16/223 |
| 5,168,426 | A * | 12/1992 | Hoving | G06F 1/1616 | 16/361 |
| 5,299,875 | A | 4/1994 | Hock et al. | | |
| 5,850,246 | A | 12/1998 | Maslanka et al. | | |
| 6,128,098 | A | 10/2000 | Kamada et al. | | |
| 6,158,085 | A * | 12/2000 | Oshiro | E05F 1/1261 | 16/303 |
| 6,280,018 | B1 | 8/2001 | Belon et al. | | |
| 6,401,298 | B1 * | 6/2002 | Lenz | E05D 11/1021 | 16/303 |
| 6,419,410 | B1 | 7/2002 | Osmus et al. | | |
| 6,530,122 | B1 * | 3/2003 | Kondou | E05D 11/1064 | 16/257 |
| 6,575,553 | B1 | 6/2003 | Williams et al. | | |
| 6,684,456 | B2 * | 2/2004 | Lee | E05D 11/1064 | 16/286 |
| 6,938,303 | B2 * | 9/2005 | Watson | E05D 3/127 | 16/247 |
| 7,028,373 | B2 * | 4/2006 | Harmon | E05D 11/1064 | 16/284 |
| 7,299,525 | B2 * | 11/2007 | Chang | H04N 1/00543 | 16/327 |
| 7,641,313 | B2 | 1/2010 | LaBar | | |
| 7,971,317 | B2 * | 7/2011 | Guo | H05K 5/0226 | 16/262 |
| 8,272,104 | B2 * | 9/2012 | Chen | G06F 1/1616 | 16/327 |
| 8,395,802 | B2 | 3/2013 | Yano et al. | | |
| 8,474,103 | B2 * | 7/2013 | Lee | E05D 15/582 | 126/194 |
| 8,650,713 | B2 * | 2/2014 | Migliorini | E05D 3/16 | 16/298 |
| 8,737,879 | B2 * | 5/2014 | Ito | B41J 29/02 | 399/124 |
| 2005/0078818 | A1 * | 4/2005 | Bae | G06F 1/1601 | 379/433.13 |
| 2005/0225934 | A1 * | 10/2005 | Homer | G06F 1/1616 | 361/679.21 |
| 2015/0191952 | A1 | 7/2015 | Pyo | | |

FOREIGN PATENT DOCUMENTS

| | | |
|---|---|---|
| JP | 2013087602 | 5/2013 |
| WO | WO-9818299 | 4/1998 |

OTHER PUBLICATIONS

The International Searching Authority, "The International Search Report and the Written Opinion, Application No. PCT/US2015/058245", dated Jul. 27, 2016, 15 pages.

* cited by examiner

HINGE SET

CLAIM FOR PRIORITY

The present application is a national stage filing under 35 U.S.C. § 371 of PCT application number PCT/US2015/058245, having an international filing date of Oct. 30, 2015, the disclosure of which is hereby incorporated by reference in its entirety.

BACKGROUND

Some apparatus have components that are coupled. One way of achieving a product footprint, for example, by adaptability and compactness, may be through a coupling connecting the two components to each other through hinge structures. Generally, hinge structures are formed by two plates pivoted along a common edge. The plates are coupled to the respective components to be foldable. Such a coupling provides compactness as well as flexibility of movement between the components.

BRIEF DESCRIPTION OF FIGURES

The detailed description is provided with reference to the accompanying figures. It should be noted that the description and the figures are merely examples of the present subject matter and are not meant to represent the subject matter itself.

FIGS. 3A-1, 3A-2, 3B-1, and 3B-2 illustrate various views of the protractible component mounted on the device, according to an example.

DETAILED DESCRIPTION

Figure 1:
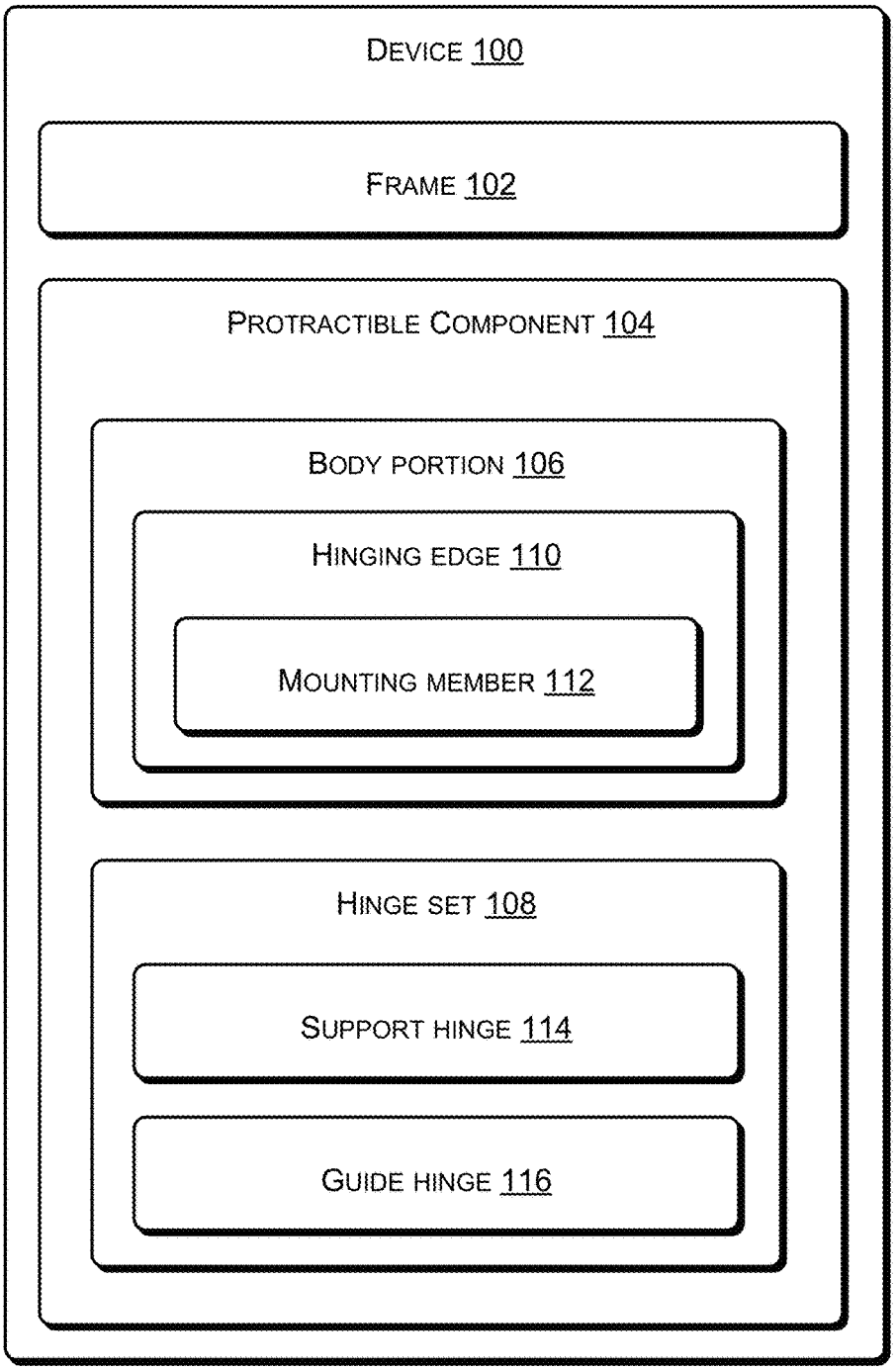
FIG. 1 illustrates a device having a hinge set for mounting a protractible component, according to an example.

Generally, hinged structures are formed by two plates pivoted along a common edge. The plates are, then, coupled to the respective components to be folded with respect to each other using fasteners, such as screws. However, such simplicity in design can curtail functional capabilities of the hinged structures. For example, the hinged structures may not be usable for components that unfold to large obtuse angles, such as angles greater than about 100°. In addition, the hinged structures may not provide a controlled movement between the two components. Further, presence of such hinged structures on outer surfaces may not be favorable to the appearance of the assembly of components.

The present subject matter relates to a hinge set, in accordance with an aspect of the present subject matter. The hinge set can be used for mounting or coupling a protractible component onto a device. In an example, the protractible component may be a tray of a reproduction device to carry a print medium from or to the reproduction device. In the present example, the reproduction device can be a printer, a facsimile machine, a copier, a scanner, or a combination thereof. Further, in another example, the protractible component can be a part, say a cover or a screen, of an audio or visual device. The protractible component can be hinged to a frame of the device and can be retracted and protracted during operation. For instance, a retracted position is a position in which the protractible component is completely drawn towards the device, whereas the protracted position is a position in which the protractible component is completely drawn away from the device.

According to an aspect, the protractible component includes a body portion and the hinge set can be used to mount the body portion to the frame of the device. The body portion can have a hinged edge at which the body portion is hinged to the frame, and a locking edge at which the body portion can detachably latch to the frame when the protractible component is retracted. The hinging edge can have a mounting member for coupling to the frame and the locking edge can have a latching member to latch to the frame. Further, the hinge set can include an elastic member and a damping element to couple the body portion to the hinge set. During operation, the elastic member is biased to provide for the body portion to protract when unlatched from the frame. In addition, the damping element can control the movement of the body portion. For instance, the damping element can provide for the body portion to slowly protract and achieve a fully protracted position, for instance, by abutting against a bumper edge of the frame, without being damaged.

Further, according to an example, the hinge set includes a support hinge and a guide hinge. A first end of the support hinge can be pivotably mounted at a fixed position on the frame and a second end of the support hinge can be pivotably coupled at a fixed position on the mounting member of the body portion. Further, a first end of the guide hinge can cooperate with the mounting member. For example, the first end of the guide hinge can have a follower and the mounting member of the body portion can be provided with an arcuate profile, such as a groove having an arcuate shape. In the present example, the follower at the first end of the guide hinge can cooperate with the arcuate profile. For instance, the follower can be movably disposed in the groove. The second end of the guide hinge can be pivotably coupled at a fixed position on the frame.

During operation, the arcuate profile of the mounting member can move with respect to the follower of the guide hinge, to allow for a guided and precise movement of the body portion during the protracting and retracting motions. In addition, pivoting of the support hinge at the mounting member provides for the pivoted movement of the body portion with reference to the support hinge. Accordingly, in a fully retracted position, the hinging edge of the body portion can be in contact and substantially aligned with the bumper edge of the frame, and can hide the hinge sets, the elastic member, and the damping element. Therefore, the hinge sets provide for lending aesthetic property to the device, in addition to providing effective retracting and protracting capability to the body portion. Additionally, in a fully protracted position, the body portion abuts against the bumper edge and a load of the body portion is borne by the bumper edge. In other words, the hinge set, the elastic member, and the damping element do not bear the load of the body portion. As a result, a service life of the hinge set the elastic member, and the damping element is enhanced.

The above aspects are further described in the figures and in associated description below. It should be noted that the description and figures merely illustrate principles of the present subject matter. Therefore, various arrangements that encompass the principles of the present subject matter, although not explicitly described or shown herein, can be devised from the description and are included within its scope. Additionally, the word "coupled" is used throughout for clarity of the description and can include either a direct connection or an indirect connection.

FIG. 1 illustrates a device 100 having a frame 102 and a protractible component 104. The device 100 is provided with a hinge set 108 for providing protractibility and retractibility, i.e., foldability, to the protractible component 104, in accordance with an example of the present subject matter. For instance, a retracted position is a position in which the protractible component 104 is completely drawn towards the frame 102, whereas the protracted position is a position in which the protractible component 104 is completely drawn away from the frame 102.

Figure 2:
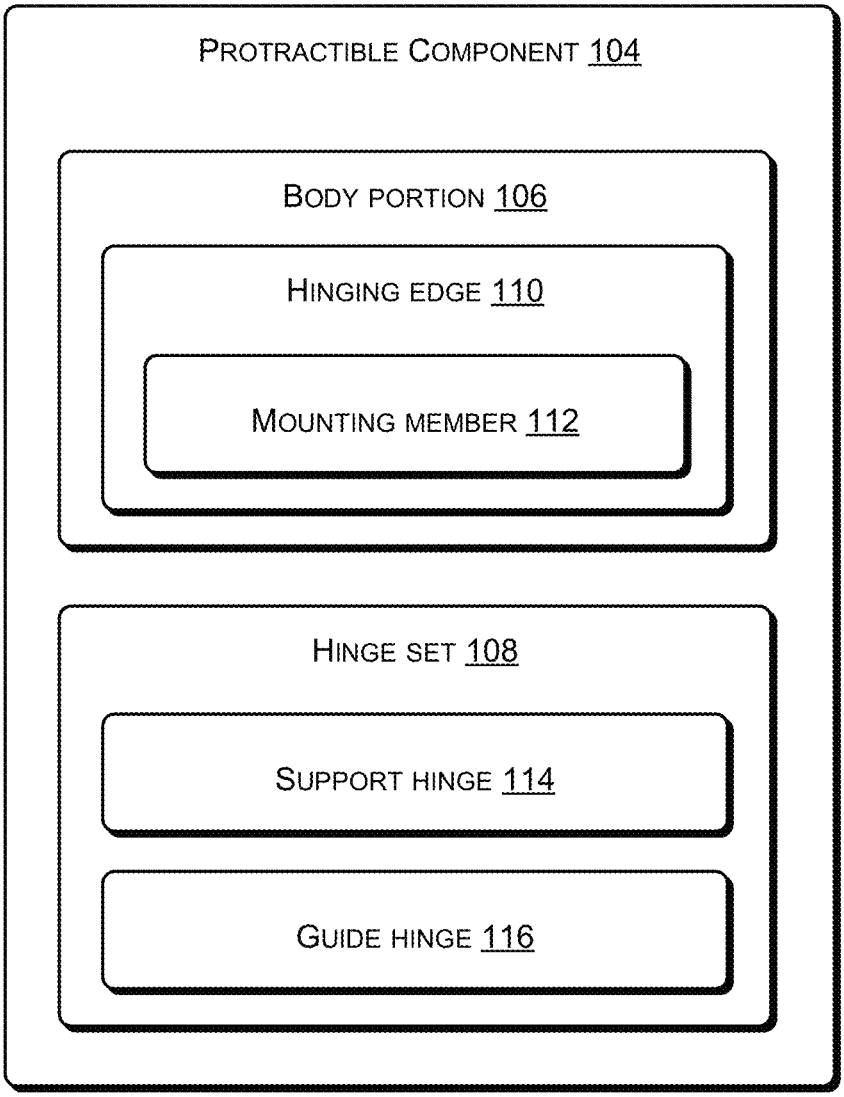
FIG. 2 illustrates a schematic of the protractible component, according to an example.

In one case, the device 100 may be a reproduction device, such as a printer, a facsimile machine, a copier, a scanner, or a combination thereof. In such a case, the protractible component 104 can be a tray of such a reproduction device for carrying print target from and to the device 100. In another case, the device 100 can be an audio-video device, such as a blu-ray disc player, a digital video disc (DVD) player, or an audio compatible disc (CD) player. In such a case, the protractible component 104 can be a cover of an optical disk drive of the audio-video device. In yet another case, however, the device 100 may be any component with which the hinge set 108 can be used for mounting another component. For instance, the protractible component 104 can be a foldable screen mounted on a roof or at a rear of a seat of an automobile. FIG. 2 illustrates a schematic of protractible component 104, in accordance with an example of the present subject matter.

As showing in FIG. 1 and FIG. 2, according to the present example, the protractible component 104 can include a body portion 106. For instance, the body portion 106 can be a planar structure having a hinging edge 110 at which the body portion 106 can be coupled to the hinge set 108, and therefore, to the frame 102. In one case, an edge of the body portion 106 measuring greater than other edges can be the hinging edge 110. In other words, the edge of the body portion 106 measuring greatest from among all the edges can be the hinging edge 110. In an example, at each end of the hinging edge 110, the body portion 106 can have a mounting member 112 having an arcuate profile formed thereon. The mounting member 112 can be used to couple the protractible component 104 to the frame 102 using the hinge set 108.

In one example, the mounting member 112 can be integrally formed with the protractible component 104 and the hinge set 108 can be non-removably coupled to the mounting member 112, thereby making the hinge set 108 a part of the protractible component 104. For instance, in the present example, the protractible component 104 can be a serviceable part. In another example, however, the mounting member 112 can be detachably attached to the protractible component 104. Accordingly, in the present example, the mounting member 112 can be a part of the hinge set 108, and the hinge set 108 can be a serviceable part and separate from the protractible component 104.

Further, the hinge set 108 can be coupled between the body portion 106 and the frame 102. For example, the mounting members 112 at each end of the hinging edge 110 of the body portion 106 and the frame 102 to achieve protractibility and retractibility of the protractible component 104. According to an aspect, the hinge set 108 can include a support hinge 114 and a guide hinge 116. The support hinge 114 and the guide hinge 116 can together provide effective pivoting movement to the protractible member 104 with respect to the frame 102.

For the purpose of providing the pivoting ability, a first end of the support hinge 114 can be pivotably mounted at a fixed position on the frame 102 and a second end of the support hinge 114 can be pivotably coupled at a fixed position on the mounting member 112. Accordingly, the support hinge 114 can pivot at fixed positions on the frame 102 as well as on the mounting member 112. Further, a first end of the guide hinge 116 can cooperate with the mounting member 112. In an example, the first end of the guide hinge 116 can have a follower to cooperate with the arcuate profile of the mounting member 112 to guide the mounting member 112. In turn, such guided motion of the mounting member 112 provides a guided motion to the protractible component 104 while protracting and retracting motions of the protractible component 104. Further, a second end of the guide hinge 116 can be pivotably coupled at a fixed position on the frame 102.

Figures 1, 3A:
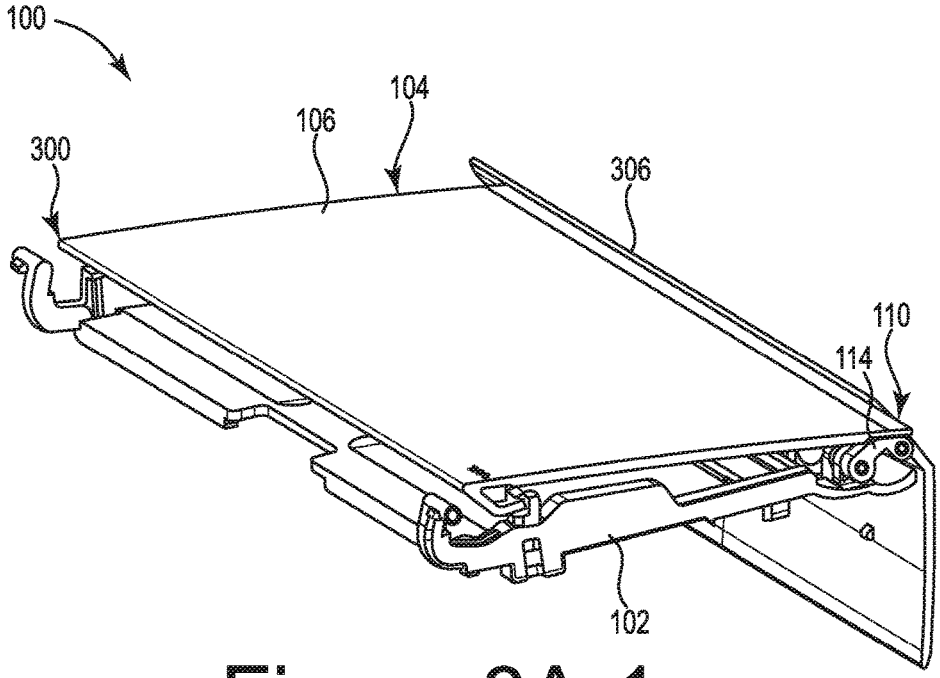
Figures 2, 3A:
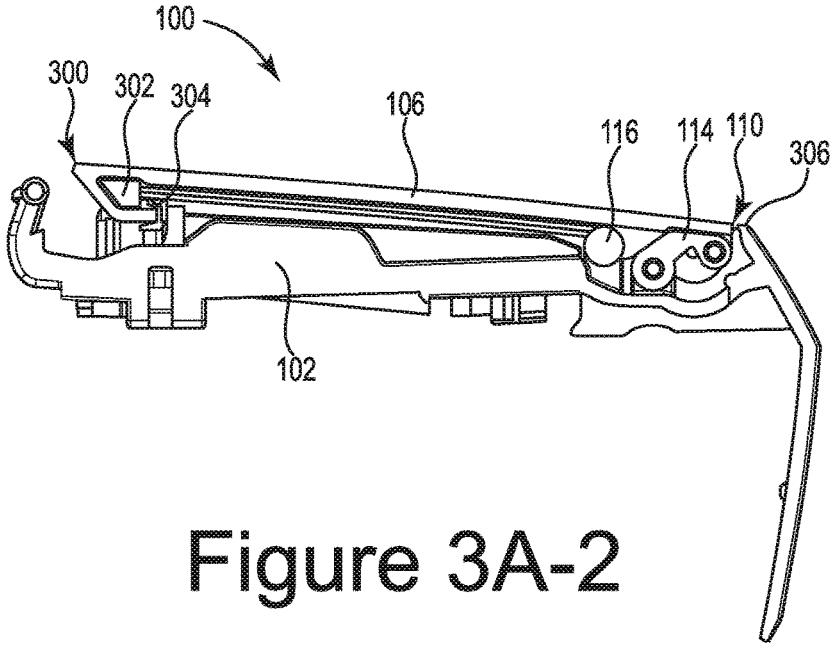
Figures 1, 3B:
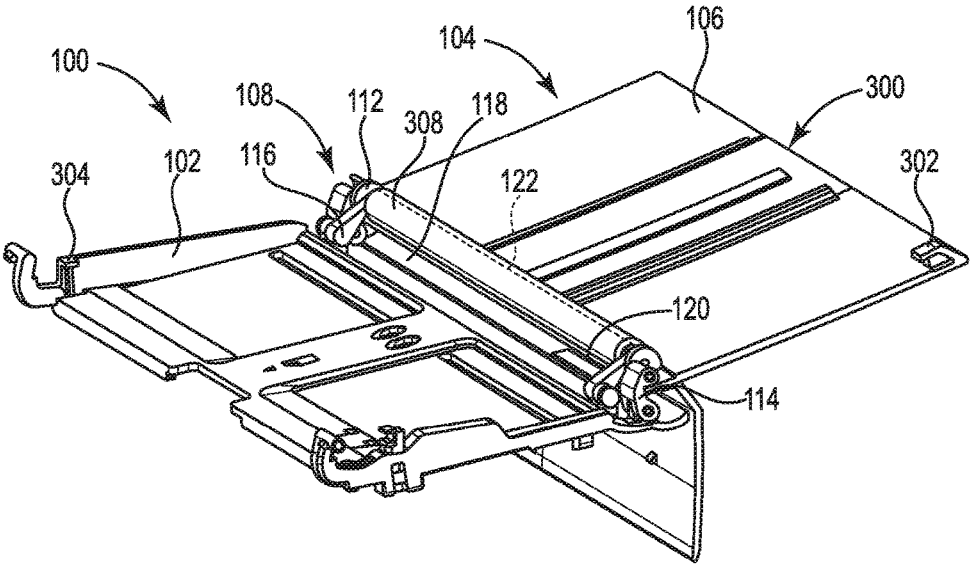
Figures 2, 3B:
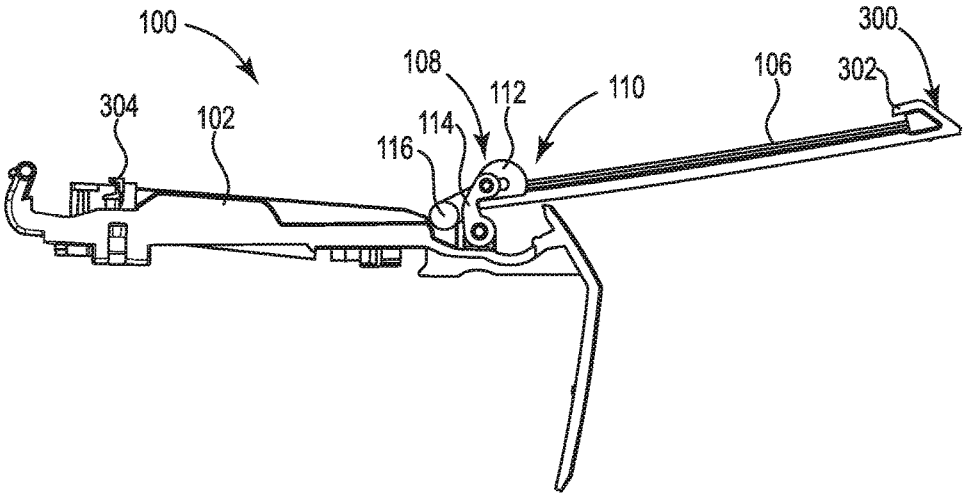

FIG. 3A-1, FIG. 3A-2, FIG. 3B-1, and FIG. 3B-2 illustrate various views of the protractile component 104 and the hinge set 108 used to deploy the protractible component 104 with the device 100, in accordance with an example of the present subject matter. FIG. 3A-1 and FIG. 3A-2 illustrate the protractible component 104 in a retracted position, whereas FIG. 3B-1 and FIG. 3B-2 illustrate the protractible component 104 in a protracted position, in accordance with an example of the present subject matter. Further, FIG. 3A-1 and FIG. 3B-1 illustrate perspective views of the protractible component 104, whereas FIG. 3A-2 and FIG. 3B-2 illustrate side views of the protractible component 104. For the sake of brevity and ease of understanding, the description of FIG. 3A-1, FIG. 3A-2, FIG. 3B-1, and FIG. 3B-2 is provided in conjunction.

As mentioned previously, the protractible component 104 can be hinged to the frame 102 of the device 100 using the hinge set 108, according an aspect of the present subject matter. In one example, the mounting member 112 on the body portion 106 can be used to couple the protractible component 104 to the frame 102 using the hinge set 108. In the present example, the mounting member 112 can be integrally formed with the protractible component 104.

Further, in the example where the mounting members 112 are provided at each end of the hinging edge 110, the protractible component 104 can be provided with a hinge set 108 at each mounting member 112. In other words, the protractible component 104 can have a single mounting location or a plurality of mounting locations for mounting on the frame 102 and, the hinge set 108 can be provided at each mounting location.

In addition, the body portion 106 of the protractible component 104 can be locked, i.e., detachably and temporarily coupled, to the frame 102 in a retracted position, as shown in FIGS. 3A-1 and 3A-2. Accordingly, the body portion 106 can have a locking edge 300 opposite to the hinging edge 110, the locking edge 300 being the edge at which the protractible component 104 can be locked with the frame 102. In an example, the locking edge 300 can have a latching member 302 to facilitate locking of the body portion with the frame 102. In turn, the frame 102 can be provided with a complementary latch 304 to engage with the latching member 302 on the body portion 106.

In one case, the complementary latch 304 of the frame can be a spring-loaded push-to-close latch, and the latching member 302 on the body portion 106 can be a hook-shaped structure. During operation, when brought in the retracted position, the hook-shaped structure of the latching member 302 can lock with a hook-shaped projection in the push-to-close latch. Further, upon pushing the body portion 106 towards the frame 102, the push-to-close latch can release the latching member 302 and the body portion 106 can be disengaged from the frame 102.

Further, in the present example, the hinge set 108 can be non-removably coupled to the mounting member 112 of the protractible component 104 to provide pivoting movement to the body portion 106 with respect to the frame 102. As mentioned previously, the support hinge 114 and the guide hinge 116 can together provide the pivoting movement to the body portion 106 with respect to the frame 102.

Accordingly, the first end of the support hinge 114 can be pivotably mounted at a fixed position on the frame 102 and the second end can be pivotably coupled at a fixed position on the mounting member 112. As a result, the body portion 106 can be provided with dual-pivoting with respect to the frame 102. With the first end of the support hinge 114 pivoted at the fixed position on the frame 102, the support hinge 114 can pivot with respect to the frame 102. Further, as the second end is pivoted at the fixed position on the body portion 106, the hinging edge 110 of the body portion 106 can pivot with respect to the support hinge 114; however, the hinging edge 110 can also be movable with respect to the frame.

Therefore, in the retracted position, the hinging edge 110 of the body portion 106 can be in contact and substantially aligned with a bumper edge 306 of the frame 102. In such a position, as shown in FIG. 3A-1 and FIG. 3A-2, the body portion 106 and the bumper edge 306 can hide the hinge set 108. Further, when the body portion 106 is disengaged from the retracted position and is moved to the protracted position, the provision of the dual-pivoting due to the support hinge 114 allows the hinging edge 110 to move away from the bumper edge 306 as the body portion 106 protracts from the retracted position. Accordingly, in the protracted position, the hinging edge 110 is farthest from the bumper edge 306, as shown in FIG. 3B-1 and FIG. 3B-2. In such a position, the body portion 106 can abut against the bumper edge 306 so that a weight of the body portion 106 can be borne by the bumper edge. Further, in such a position, the body portion 106 of the protractible component 104 can extend or open to an angle of about 160° to 180° in the protracted position. However, the angle to which the body portion 106 can protract can depend on design of the bumper edge 306 or of the protractible component 104, i.e., the hinge set 108 and the body portion 106, or both. For instance, in the protracted position, the protractible component 104 can extend or open to an angle in a range from about 100° to 200°.

Therefore, the mounting of the body portion 106 to the frame 102 using the support hinge 114 can allow the same bumper edge 306 to act as a projection in the retracted position to hide the moving parts, for instance, of the protractible component 104, thereby achieving a pleasing appearance to the device 100, and to also act as a weight bearing part for the body portion 106.

Further, the guide hinge 116 can provide a guided motion to the protractible component 104, i.e., to the body portion 106, while protracting and retracting motions of the protractible component 104. As mentioned previously, the second end of the guide hinge 116 can be pivotably coupled at a fixed position on the frame 102. In addition, the first end of the guide hinge 116 can cooperate with the mounting member 112, for instance, with the arcuate profile (not shown) of the mounting member 112, to achieve the guided motion of the body portion 106.

In an example, the arcuate profile of the mounting member 112 can be formed as a groove 122 in the mounting member 112 having an arcuate shape. In the present example, the first end of the guide hinge 116 can have a follower which can cooperate with the arcuate profile, i.e., with the groove 122 in the mounting member 112. For instance, the follower of the guide hinge 116 can be movably disposed in the groove 122. Accordingly, when the body portion 106 is retracted or protracted, the follower and the groove 122 can move in a coordinated manner so that the groove 122 is guided along the follower, to provide a guided movement to the body portion 106.

In another example, the first end of guide hinge 116 can be simply pivoted at the mounting member 112. In such a case, the movement of the body portion 106 during retraction and protraction can be so organized that the guide hinge 116 can pivot with respect to the frame 102 at the second end, and the first end can still guide the movement of the body portion 106 in coordination with the support hinge 114. For instance, in such a case, the guide hinge 116 can also assist the movement of the hinging edge 110 towards and away from the bumper edge 306 of the frame 102, in the manner as explained previously.

Further, the protractible member 104 can have provisions for a regulated movement of the body portion 106, for instance, when the body portion 106 is protracting. Accordingly, in accordance with an aspect of the present subject matter, the protractible component 104 can have an elastic member 120 coupled between the body portion 106 and the hinge set 108, in turn, to couple the body portion 106 to the frame 102. For example, the elastic member 120 can be coupled between the mounting member 112 and the first end of the guide hinge 116. In another example, the elastic member 120 can be coupled directly between the body portion 106 and the frame 102.

The elastic member can provide for mechanized protraction of the protractible component 104 when the body portion 106 is unlocked from the frame 102, i.e., when the latching member 302 of the body portion 106 is released from the complementary latch 304 of the frame 102. For instance, the elastic member can be a compression spring which expands to regain original state when the body portion 106 is released.

Further, to control the movement of the body portion 106 due to when released and protracting, the protractible component 104 can have a damping element 118. The damping element 118, in a similar manner as the elastic member, can be coupled between the body portion 106 and the hinge set 108. In another example, however, the damping element 118 can be provided directly between the body portion 106 and the frame 102.

In addition, to protect the elastic member and the damping element, the protractible component 104 can be provided with a housing 308 to house the elastic member and the damping element. For example, the housing 308 can protect the elastic member and the damping element from exposure to dust, thereby preventing accumulation of grime, as well as to damage. As a result, a service life of the parts, i.e., the elastic member and the damping element, can be enhanced, as an example.

Figure 4:
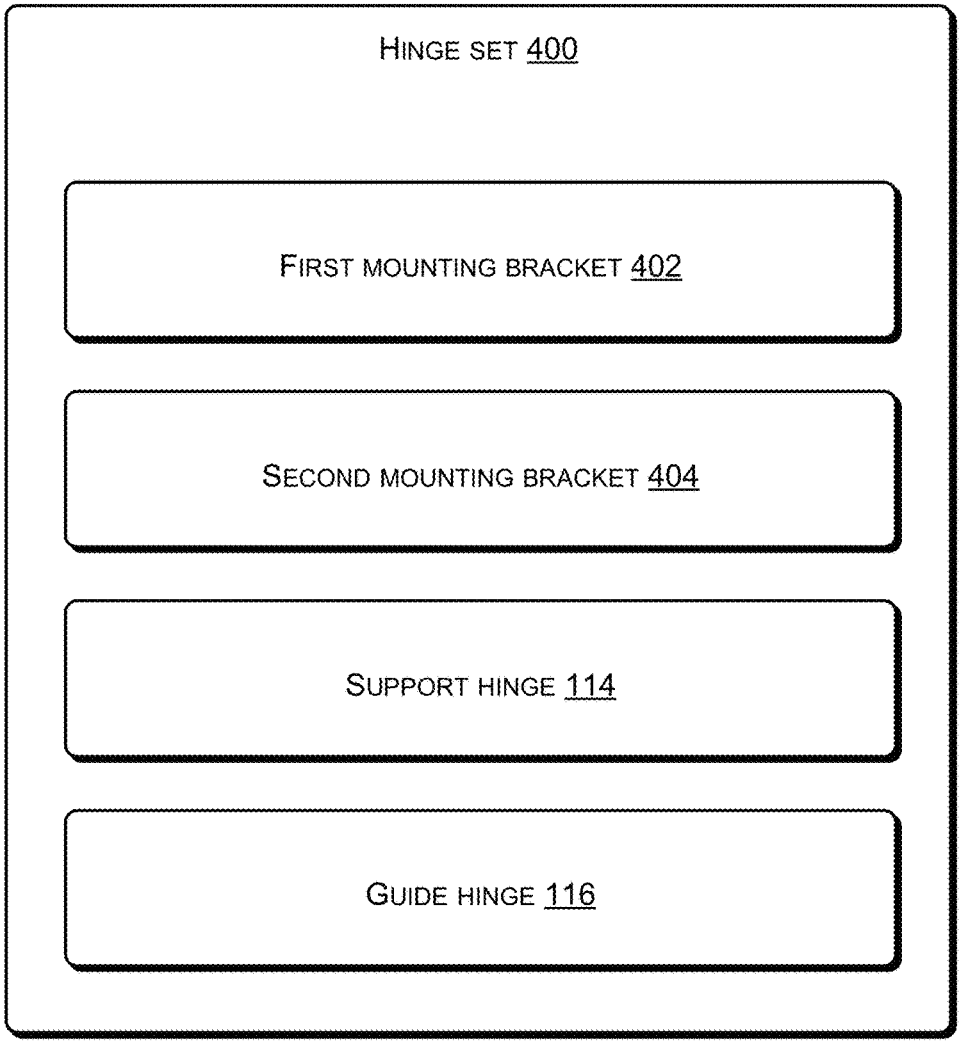
FIG. 4 illustrates a schematic of a hinge set for mounting the protractible component on the device, according to an example.

FIG. 4 illustrates a schematic of a hinge set 400, in accordance with another example of the present subject matter. In the present example, the hinge set 400 is formed as a serviceable part and, therefore, separable from the protractible component 104.

In the present example, the hinge set 108, in addition to the support hinge 114 and the guide hinge 116, can include a first mounting bracket 402 to couple the hinge set 400 to the protractible component 104, and a second mounting bracket 404 to couple the hinge set 106 to the device 100, i.e., to the frame of the device 100, for mounting the protractible component onto the device 100. Further, to form the hinge set 400, the first end of the support hinge 114 can be pivotably coupled to the first mounting bracket 402 and the second end of the support hinge 114 is pivotably coupled to the second mounting bracket 404. Similarly, the first end of the guide hinge 116 can cooperate with the first mounting bracket, and a second end of the guide hinge is pivotably coupled to the second mounting bracket.

Figure 5:
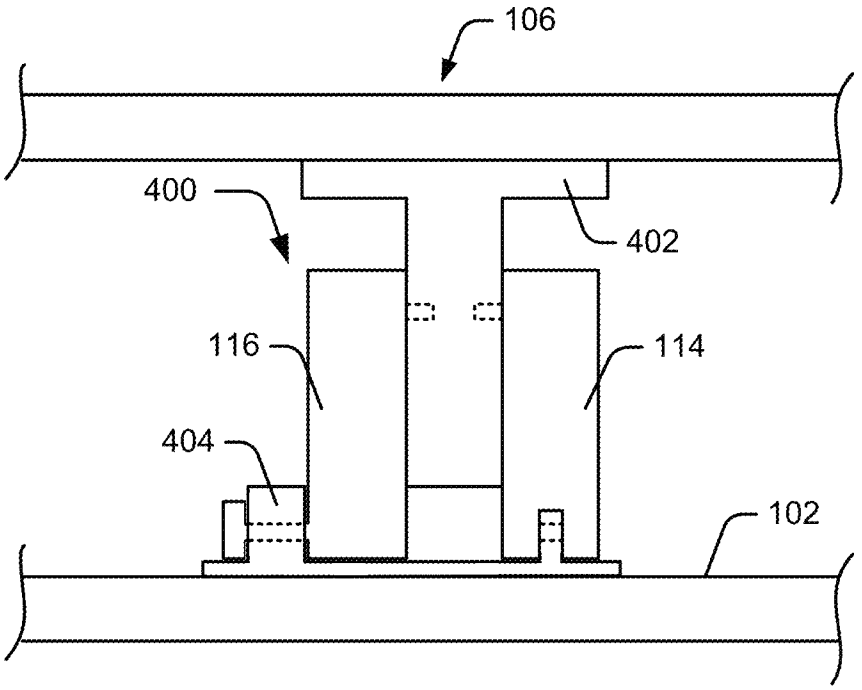
FIG. 5 illustrates a front view of the hinge set for mounting the protractible component on the device, according to an example.

FIG. 5 illustrates a front view of the hinge set 400, in accordance with an example of the present subject matter. As shown in FIG. 5, the first mounting bracket 402 can be employed for coupling the hinge set 108 to the protractible component 104, i.e., to the body portion 106. In other words, the first mounting bracket 402 can be the mounting member 112 being formed as part of the hinge set 400 instead of the protractible component 104. Accordingly, the first mounting bracket 402 can be pivotably coupled to the first end of the support hinge 114 at a fixed position. In addition, the first mounting bracket 402 can have an arcuate profile and the first end of the guide hinge 116 can cooperate with the arcuate profile, in the manner described previously.

The first mounting bracket 402 can be coupled to the protractible component 104 using a single or a variety of mounting mechanisms. For example, the first mounting bracket 402 can be coupled using fasteners, glue, or other similar ways.

Further, the second mounting bracket 404 can be used for coupling the hinge set 108 to the device 100, i.e., to the frame 102 of the device, for mounting the body portion 106 onto the frame 102. In the present example, the second mounting bracket 404 can be pivotably coupled to the second edge of the support hinge 114 at a fixed position and to the second edge of the guide hinge 116 at a fixed position. For instance, the second mounting bracket 404 can be coupled to the frame 102 in the same manner as the first mounting bracket 402 is coupled to the body portion 106. In another case, the first mounting bracket 402 and the second mounting bracket 404 can be mounted to the body portion 106 and the frame 102, respectively, using different mounting mechanisms.

Although aspects of the hinge set 108 for the protractible component 104 have been described in language specific to structural features and/or methods, it is to be understood that the appended claims are not limited to the specific features or methods described. Rather, the specific features and methods are disclosed as examples for the hinge set 108 for the protractible component 104.

We claim:

1. A protractible component for a device, the protractible component comprising:

a body portion comprising a hinging edge having a mounting member to hinge the body portion to a frame of the device; and a hinge set coupled to the body portion to hinge the body portion to the frame, the hinge set comprising:

a support hinge comprising a first end and a second end, wherein the first end of the support hinge is to be pivotably mounted at a fixed position on the frame and the second end of the support hinge is to pivotably couple at a fixed position on the mounting member of the body portion;

a guide hinge comprising a first end and a second end, wherein the first end of the guide hinge is to cooperate with the mounting member to guide the mounting member, and the second end of the guide hinge is to pivotably couple at a fixed position on the frame;

an elastic member to couple the body portion to the hinge set, wherein the elastic member is to protract the protractible component; and a damping element to couple the body portion to the hinge set, wherein the damping element is to control protraction by the elastic member.

2. The protractible component as claimed in claim 1, wherein the mounting member comprises a groove to cooperate with a follower at the first end of the guide hinge.

3. The protractible component as claimed in claim 1, wherein the body portion comprises a locking edge having a latching member to detachably latch the body portion to the frame when the protractible component is retracted.

4. The protractible component as claimed in claim 1, further comprising a housing to house the elastic member and the damping element.

5. The protractible component as claimed in claim 1, wherein the body portion is to extend from the mounting member about a bumper edge to an angle of about 160° to 180° in a protracted position.

6. A device comprising:

a frame;

a protractible component comprising:

a body portion comprising a hinging edge having a mounting member at each end of the hinging edge, each mounting member having an arcuate profile formed thereon; and a hinge set coupled between each mounting member and the frame to achieve protractibility of the protractible component, each hinge set comprising:

a support hinge comprising a first end and a second end, wherein the first end of the support hinge is pivotably mounted at a fixed position on the frame and the second end of the support hinge is pivotably coupled at a fixed position on the mounting member of the body portion;

a guide hinge comprising a first end and a second end, wherein the first end of the guide hinge comprises a follower to cooperate with the arcuate profile of the mounting member to guide the mounting member, and the second end of the guide hinge is pivotably coupled at a fixed position on the frame;

an elastic member to couple the body portion to the hinge set, wherein the elastic member is to protract the protractible component; and a damping element to couple the body portion to the hinge set, wherein the damping element is to control protraction by the elastic member.

7. The device as claimed in claim 6, wherein the arcuate profile is formed as a groove in the mounting member.

8. The device as claimed in claim 6, wherein the body portion comprises a locking edge having a latching member to detachably latch the body portion to the frame when the protractible component is retracted.

9. The device as claimed in claim 6, wherein the protractible component is one of a tray for a reproduction device, a screen, and a cover.

10. The device as claimed in claim 6, wherein the protractible component is to open from the mounting member about a bumper edge to an angle of about 160° to 180° in a protracted position.

11. A hinge set for a protractible component of a device, the hinge set comprising:

a first mounting bracket to couple the hinge set to the protractible component;

a second mounting bracket to couple the hinge set to the device for mounting the protractible component on the device;

a support hinge comprising a first end and a second end, wherein the first end of the support hinge is pivotably coupled to the first mounting bracket and the second end of the support hinge is pivotably coupled to the second mounting bracket;

a guide hinge comprising a first end and a second end, wherein the first end of the guide hinge cooperates with the first mounting bracket to guide the first mounting bracket, and the second end of the guide hinge is pivotably coupled to the second mounting bracket;

an elastic member to protract the protractible component; and a damping element to control protraction by the elastic member, wherein the elastic member and the damping element are coupled between the first mounting bracket and the second mounting bracket.

12. The hinge set as claimed in claim 11, wherein the first mounting bracket comprises a groove having an arcuate shape, the first end of the guide hinge comprising a follower to cooperate with the groove.

* * * * *